United States Patent [19]

Stevens et al.

[11] 4,124,968

[45] Nov. 14, 1978

[54] CONTENT ACTIVATED ENVELOPE EXTRACTION

[75] Inventors: Albert F. Stevens, Moorestown; Paul E. Haley, Hammontown, both of N.J.

[73] Assignee: Opex Corporation, Cherry Hill, N.J.

[21] Appl. No.: 813,810

[22] Filed: Jul. 8, 1977

[51] Int. Cl.[2] ..... B65B 43/30

[52] U.S. Cl. ..... 53/381 R; 250/223 R

[58] Field of Search ..... 53/78, 381 R, 391; 271/263; 250/223; 214/1 M; 83/304, 912; 209/111.7 T, DIG. 1; 198/341; 356/240

[56] References Cited

U.S. PATENT DOCUMENTS

| | | | |
|---|---|---|---|
| 2,625,309 | 1/1953 | Cox | 53/391 |
| 3,003,631 | 10/1961 | Stock | 209/111.7 T X |
| 3,026,419 | 3/1962 | Aweida et al. | 250/223 R |
| 3,283,897 | 11/1966 | Harille | 209/111.7 T |
| 3,310,304 | 3/1967 | Foias et al. | 271/263 |
| 3,384,252 | 5/1968 | West | 53/381 R X |
| 3,614,419 | 10/1971 | Daughton | 250/223 R |
| 3,799,337 | 3/1974 | Green | 209/111.7 T |
| 3,979,884 | 9/1976 | Russeu | 53/381 R |
| 4,016,708 | 4/1977 | DeHart | 83/912 X |
| 4,016,980 | 4/1977 | DeHart et al. | 250/223 R X |

*Primary Examiner*—John Sipos

*Attorney, Agent, or Firm*—Weiser, Stapler & Spivak

[57] ABSTRACT

At the content extraction location radiant energy is transmitted through the spread-open envelope. Change in this transmitted energy due to content extraction is sensed and activates removal of the envelope from the extraction location.

14 Claims, 3 Drawing Figures

CONTENT ACTIVATED ENVELOPE EXTRACTION

Figure 1:
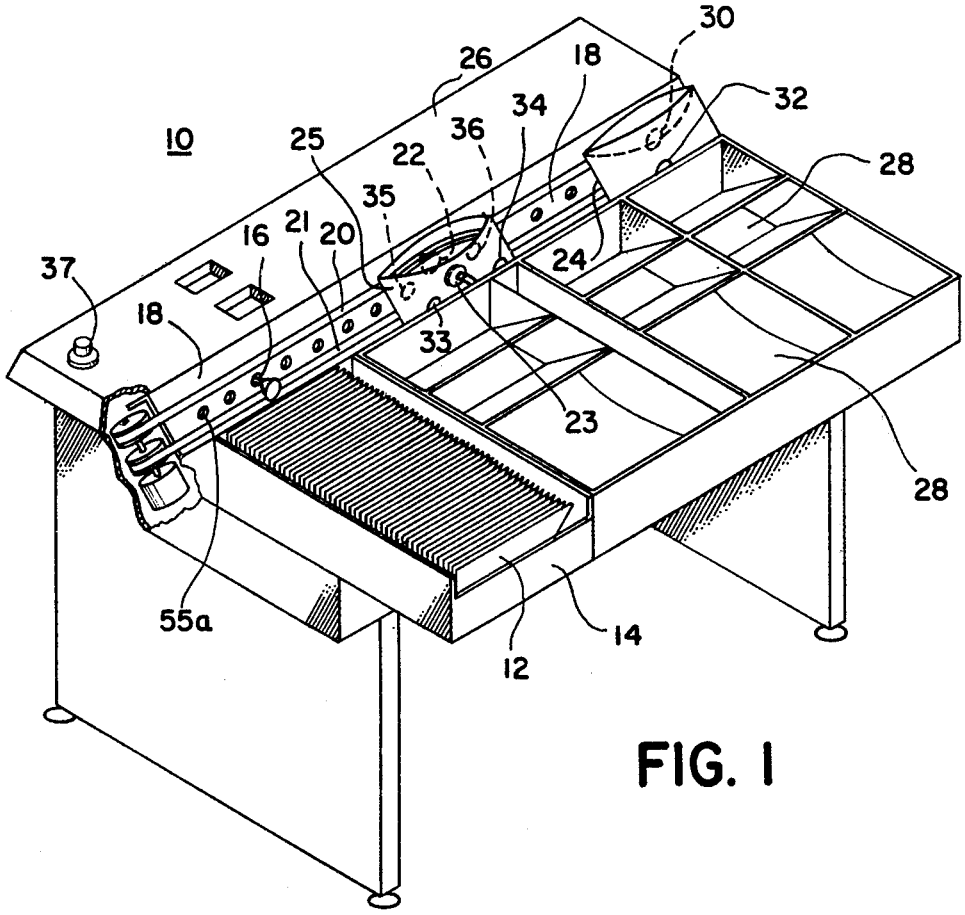

The invention relates to improvements in machinery which facilitates the extraction of contents from envelopes.

It is known that there are many situations in which it is desirable to extract the contents from large numbers of envelopes within a short period of time. Such a situation is encountered, for example, in mail order businesses, in banks, in the offices of utilities, and in other establishments where large numbers of envelopes are received containing order blanks, checks, check stubs, and so forth.

Machinery is known for assisting an operator in performing the various operations involved in the extraction of such contents so as to enhance the speed and reliability with which this extraction takes place. Machines are known for slitting the envelopes open along one or more edges. Machines are known for spreading the opposite faces of the opened envelopes apart to give the operator easy access to their contents. Finally, machines are known which verify that content extraction has taken place before the (now empty) envelopes are ultimately disposed of.

The one step in all of these mechanized functions which is frequently still performed manually by the operator is the actual extraction of the contents from the spread-open envelope. Machines have been devised which can also perform this extraction automatically. For example, there is U.S. Pat. No. 3,884,010 which purports to do so. There is also U.S. Pat. No. 3,384,252 which discloses a different technique for mechanized content extraction. Nevertheless, the manual method remains in wide useage even in machinery in which all the other functions have been mechanized and automated.

It is believed that there are at least two reasons for continuing to use manual extraction. One is that it simplifies the machinery, and makes it less costly. The other — and perhaps more important — reason is that it is more reliable. In a practical situation, envelope contents present themselves in a wide variety of specific forms. In some envelopes, the contents may have been inserted folded, in others not. In some envelopes, the contents may unintentionally adhere to an inner face of the envelope. In some envelopes, the contents may be positioned bunched at one side rather than neatly centered. These and many other variations in content configuration can occur even when theoretically all envelopes being processed have the identical contents.

This places a premium on human dexterity and judgment, which make it easy to extract the envelope contents completely and reliably, notwithstanding the well-nigh infinite variety of circumstances which may be encountered in practice.

Desirable though such operator intervention may be, from the standpoint of being able to cope with the vagaries of envelope content extraction, this also presents a problem. The problem is one of timing. The consecutive envelopes must be carried to the location at which the operator is positioned, they must be permitted to dwell for a period of time sufficiently long to enable the operator to perform the content extraction, and they must then be removed from that location so that following envelopes can take their place.

A timing sequence in which the period of dwell in the extraction location is the same for consecutive envelopes presents the problem that this dwell period must be made long enough so that the most time-consuming extraction manipulation that may be required in practice can be accomplished by the operator. For all those envelopes whose contents can be extracted in less than this maximum period, the excess time is wasted, and the effective speed of envelope extraction correspondingly reduced.

An alternative approach is to provide the operator with a control, usually in the form of a foot pedal, whose activation carries away from the extraction location whatever envelope is present there and brings the next envelope into that location. This provides the operator with a timing flexibility which makes it possible to match the dwell time of each envelope at the extraction location more closely to the needs of content extraction. If removal of the contents from a particular envelope takes a long time, then the actuation of the carry-away operation is delayed. If content extraction takes a short time, then actuation of the carry-away operation is speeded up. Overall, less time is wasted and the effective speed of content extraction is enhanced.

Even then, however, there is still a problem of coordinating the content extraction operation and the actuation of the operation which carries the (now empty) envelope away from the extraction location, where it is replaced by a fresh envelope whose contents have not yet been extracted. The right coordination must be learned and, even after it has been learned, it is still subject to variations in actual performance. These variations may amount to only a rather short interval per envelope, perhaps only one second in duration or even less. However, when dealing with modern machines capable of processing as many as 1200 envelopes per hour (which works out to one envelope every three seconds), or even more, a delay of one second, or even of a fraction of a second, represents a very significant reduction in overall processing rate.

Accordingly, it is an object of the present invention to provide an improved machine for assisting in the extraction of contents from envelopes.

It is another object to provide such a machine which is capable of producing improved coordination between the dwell time of envelopes at the content extraction location and the time needed to extract the contents from each envelope as it arrives at that location.

It is still another object to provide such a machine which minimizes the time delay between content extraction and carrying away of the envelope from the extraction location.

It is still another object to minimize the above-mentioned time delay even though different envelopes may require manipulations of different complexity — and therefore of different duration — in order to empty them of their contents.

It is still another object to provide such a machine which also reduces the tendency for the operator to leave residual contents in the envelope.

These and other objects which will appear are achieved in accordance with the invention as follows. At the extraction location of the machine, means are provided which sense the physical extraction of the contents from the envelope, and which respond to this extraction to restart the machine and cause same to carry away the now-empty envelope from the extraction location.

Preferably the means for sensing the content extraction includes a source of radiant energy (preferably light) which is transmitted through the envelope presented to the operator for content extraction. Sensing means for the transmitted energy are provided (e.g., one or more photocells) which sense the change in the transmitted energy attributable to extraction of the contents and produce an electrical control signal for starting the carry-away operation.

Also preferably, this automatic function is integrated into the overall operating cycle of the machine so that other operational features are not adversely affected.

Figure 2:
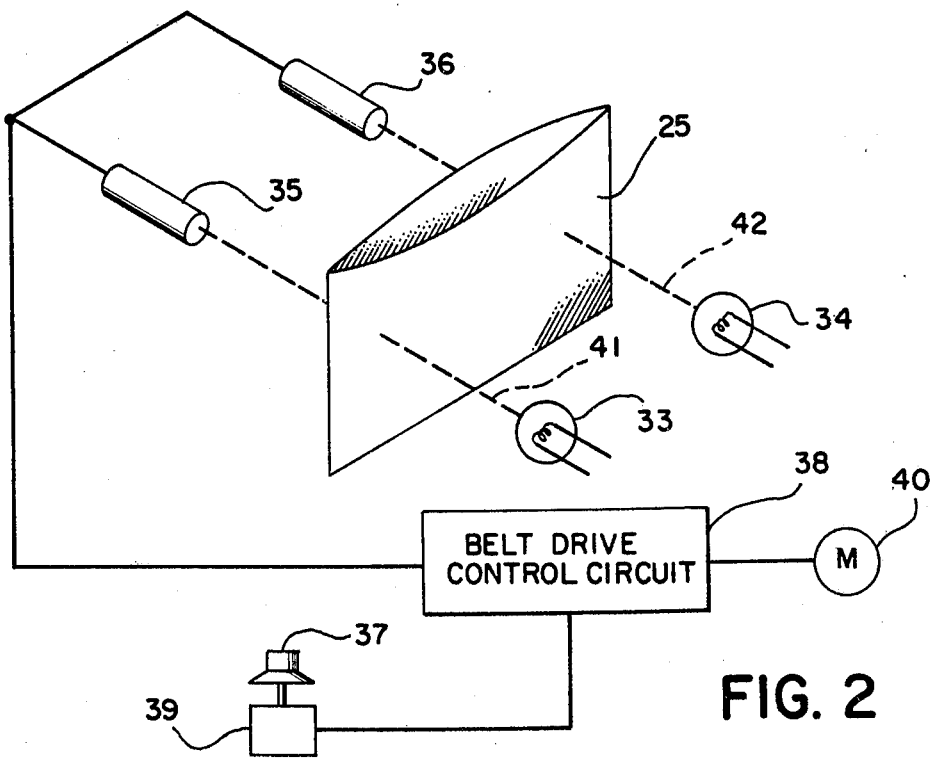
Figure 3:
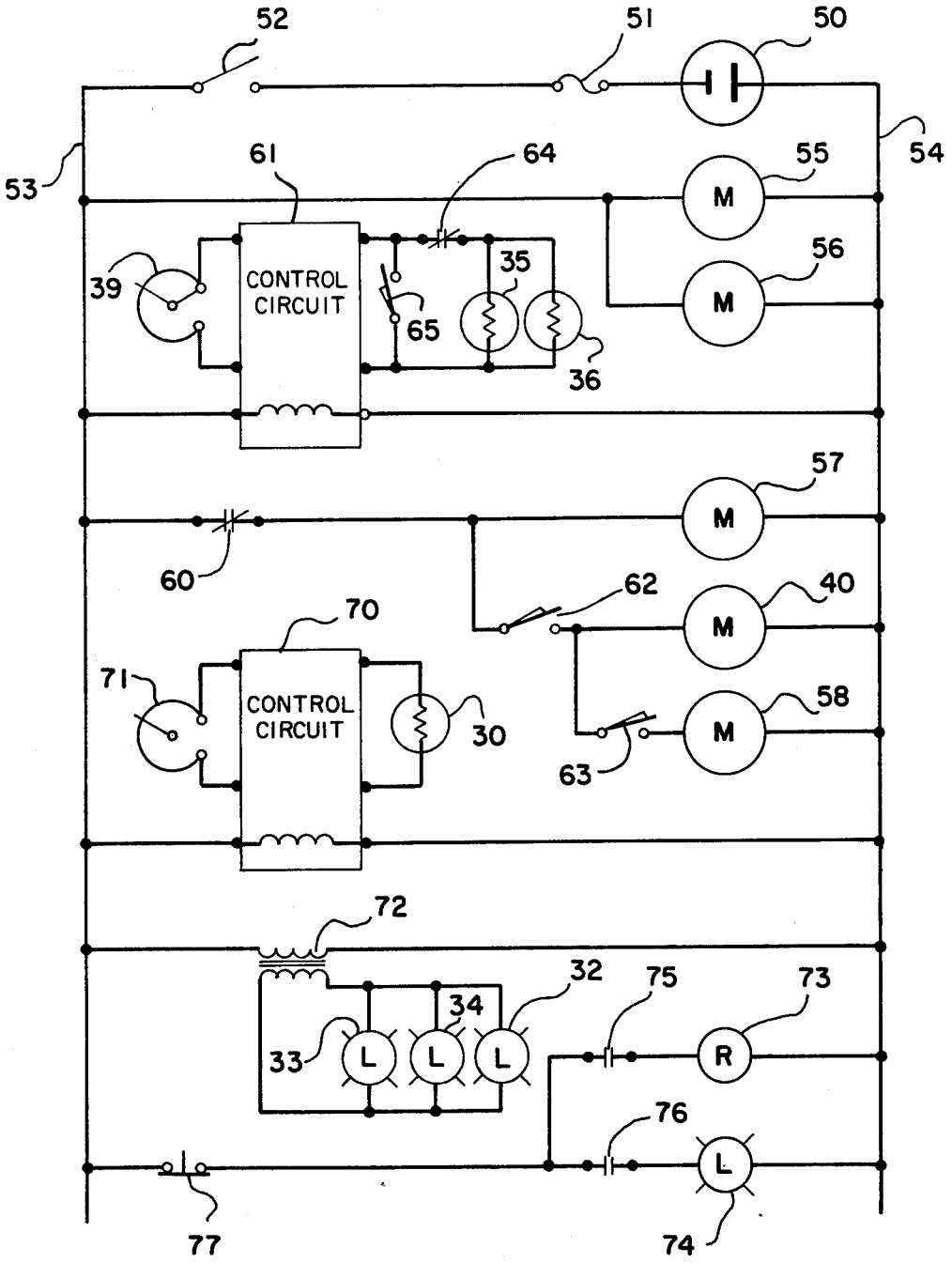

For further details, reference is made to the discussion which follows, in light of the accompanying drawings wherein FIG. 1 is an overall view of a machine embodying the present invention;

FIG. 2 is a block diagram illustration of the electrical elements which are utilized in practicing the present invention; and FIG. 3 is a more detailed illustration of the manner in which the electrical elements of FIG. 2 are connected to other elements forming part of the machine of FIG. 1.

The same reference numerals are used in the several figures to designate corresponding elements.

Referring to FIG. 1, this shows a machine 10 of known type used in assisting a human operator with the extraction of contents from envelopes.

A group 12 of these envelopes which have previously been opened along one edge is shown in FIG. 1 stored for processing by machine 10 in bin 14, with the opened edges uppermost. One after another, these envelopes are removed from bin 14 by suction cup 16, which alternately extends into engagement with the nearest envelope in the bin, and retracts back into sloping shelf 18, carrying the envelope with it. Each such envelope is then propelled by conveyor belts 20, 21 along shelf 18 toward the upper right in FIG. 1. The belts are stopped when the envelope reaches a position between suction cups 22, 23. These suction cups 22, 23 are then moved toward each other until they engage the opposite sides of the envelope. Then they are again moved apart, in the process also spreading the sides of the envelope open. An envelope with its sides spread open in this manner is shown at 25 in FIG. 1. This spreading open of the envelope is designed to afford the opportunity for conveniently extracting any contents which may be present in the envelope. To that end, an operator (not shown) may be positioned alongside shelf 26 and this operator would then reach into the spread-open envelope 25 and extract its contents. The position occupied by envelope 25 is therefore referred to herein as the content extraction location.

Facilities in the form of storage bins 28 are provided to facilitate sorting of the extracted contents by the operator.

Next, the suction in suction cups 22, 23 is released, thereby permitting the envelope to reassume generally the same configuration and position which it had before it had been spread open at 25.

The conveyor belts 20, 21 also resume their interrupted movement, carrying the envelope further in the same direction as before, and ultimately carrying it beyond the end of the machine 10, where it is disposed of, e.g. by being allowed to drop into a waste receptacle (not shown).

Before reaching that end of machine 10, the envelope is caused to pass between a combination of photocell 30 and light bulb 32. These in effect "candle" the passing envelope. If they detect the presence of contents which (for one reason or another) have not been extracted by the operator, they stop the belts 20, 21 and the operator can then intervene, inspect the envelope in question, and extract any residual contents.

Further details concerning the type of machine which has been described up to this point are provided in U.S. Pat. No. 3,979,884.

In accordance with the present invention, there are further provided in the machine 10 of FIG. 1 an additional pair of light bulbs 33, 34 and an additional pair of photocells 35, 36. These light bulbs and photocells are positioned respectively on opposite sides of the path followed by the envelopes along conveyor belts 20, 21. Photocell 35 and light bulb 37 are both positioned upstream from the suction cups (in relation to the direction of conveying movement of the envelopes). They are so aligned that the photocell 35 receives mainly light from light bulb 33. Photocell 36 and light bult 34 are both positioned downstream from suction cups 22, 23 and they are so aligned that photocell 36 receives light primarily from light bulb 34. Suitable shielding may be provided for the light bulbs and the photocells, if necessary, in order to provide the desired relationship of light emission and reception as described above. Moreover, all these elements must be positioned so that they will not interfere with the movements executed by the envelopes.

Thus light bulbs 33, 34 should not protrude so far toward sloping shelf 18 that they prevent suction cup 23 from adequately spreading open the side of envelope 25 engaged by that cup. Photocells 35, 36 should not protrude from sloping shelf 10 far enough to interfere with the movement of envelopes by belts 20, 21 or with the functioning of suction cup 22 in contributing to the holding open of the envelope 25. The spacing of light bulbs 33, 34 and photocells 35, 36 on the upstream and downstream sides of suction cups 22 and 23, respectively, is such that the light directed from bulb 33 toward photocell 35 will be intercepted by an envelope 25 being held spread open by the suction cups. Likewise, the spacing of light bulb 34 and photocell 36 downstream from suction cups 22, 23 is such that the light passing from bulb 34 to photocell 36 will also be intercepted by envelope 25. Preferably these spacings upstream and downstream from suction cups 22, 23 are such that the portions of envelope 25 which intercept the light between each set of light bulb and photocell are not very close to the narrow edges of th envelopes but rather are some distance in from these narrow edges toward the center of the envelope. Likewise the positioning of these light bulb-photocell sets in a direction transverse to the lengthwise edges of the envelopes is preferably such that the light is intercepted approximately midway up from the bottom toward the top of the envelope.

Also provided on machine 10 of FIG. 1 is a control knob 37 which cooperates with the remainder of the machine, and particularly with the portions of the machine involving light bulbs 33, 34 and photocells 35, 36, in a manner more fully described below.

FIG. 2 to which reference may now be made shows the basic interaction between the components which particularly characterize the present invention. That figure shows an envelope 25 in position between the light bulbs 33, 34 and the photocells 35, 36. The envelope 25 is shown with its open edge spread open, but the suction cups which accomplish this spreading have not been illustrated in FIG. 2 in order to avoid cluttering that figure with unnecessary illustrative material.

Also the remainder of the structure of machine 10 has been omitted in order to show more clearly the relationships between the specific elements illustrated in FIG. 2.

As shown in that figure, the output connections from photocells 35 and 36 are connected together and jointly connected to the input to belt control drive circuit 38. Another input to this control circuit 38 comes from a potentiometer 39. Control knob 37 is connected to actuate potentiometer 39. The output of control circuit 38 is connected to motor 40 which is that motor within machine 10 (FIG. 1) which drives belts 20, 21. It will be understood that suitable sources of driving power are provided for the various elements illustrated in FIG. 2. For example, light bulbs 33 and 34 may be supplied with suitable electrical current so as to be illuminated continuously while machine 10 is in operation. As a result, light is continuously directed from bulb 33 toward photocell 35 along the path indicated by broken line 41 in FIG. 2 and light is also continuously directed from bulb 34 toward photocell 36 along the path indicated by broken line 42 in FIG. 2. When no envelope 25 is present, the intensity of light thus impinging upon photocells 35 and 36 is at a maximum. Conversely, when an envelope 25, with its contents not yet extracted, is present, that envelope and its contents intercept the light traveling from light bulbs 33, 34 to photocells 35, 36 respectively and thereby reduce the light impinging upon these photocells to a minimum. An intermediate condition exists after the contents have been extracted from envelope 25. At that time only the envelope itself impedes the passage of light from light bulbs to photocells and, therefore, a greater intensity of light will reach the photocells than before content extraction, although still less than if no envelope is present at all.

It is the change in light reception by photocells 35, 36 between the minimum condition existing before content extraction and the higher intensity condition prevailing after content extraction which controls motor 40. When the minimum condition exists, in the presence of an envelope 25 before its contents have been extracted, the belt drive control circuit 38 responds to stop motor 40 from operating and thereby from transporting envelope 25 away from the extraction location. When the light received by these photocells increases in response to extraction of the contents from envelope 25, the control circuit 38 responds by reactivating motor 40, which then becomes capable of removing the envelope 25 from the content extraction location and continuing its movement along belts 20, 21 and sloping shelf 18 toward the upper right in FIG. 1.

The level of light at which this resumption of motor 40 operation in response to control circuit 38 takes place is determined by potentiometer 39 under the control of knob 37.

Further details concerning this electrical circuitry are provided in FIG. 3 to which reference may now be had. That figure shows essentially the entire electrical circuitry of the machine of FIG. 1, including not only the specific portions which form part of FIG. 2 but also the remaining portions, so as to provide a complete overview of the manner in which the present invention fits in with the remainder of the electrical circuitry on the machine.

As shown in FIG. 3, this circuitry includes a conventional line plug 50, a fuze 51 and a main on-off switch 52 for the machine. When this switch is closed, there is developed across leads 53, 54 the conventional line voltage of, say, 120 volts AC. The remainder of the circuitry is then connected in one way or another between these main leads 53, 54 and derives its power from these leads.

This circuitry includes five motors 40 and 55 through 58. Motor 55 drives a blower whose purpose it is to create suction in holes **55*a* which line shelf 18. This suction tends to hold the envelopes in engagement with moving belts 20, 21**.

Motor 56 drives a vacuum pump whose purpose it is to provide suction to the various portions of machine 10 of FIG. 1 requiring such suction. For example, suction is required by suction cups 16, 22 and 23. That suction is provided by the pump (not shown) which is driven by motor 56. It will be noted that motors 55 and 56 operate continuously whenever switch 52 is closed.

Motor 57 drives the various cam mechanisms (not shown) which operate (and thereby also control the timing of) the various suction cups shown in FIG. 1, and microswitches shown in FIG. 3. Connected across motor 57 is a series combination of motor 40 (whose function has previously been described) and microswitch 62. Further connected across motor 40 is the series combination of motor 58 and another microswitch 63. Motor 58 is that motor which drives the mechanism which urges the envelopes 12 stacked within bin 14 in the machine of FIG. 1 toward suction cup 16. This urging may be provided in a variety of conventional ways as, for example, by driving chains placed below bin 14 and contacting the lower edges of the envelopes 12 stacked within the bin through slots in the bottom of bin 14.

As discussed more fully hereafter, motor 57 is controlled by a relay switch 60 which is normally closed. Switch 60 is subject to being opened in response to the operation of a control circuit diagrammatically indicated by rectangle 61.

Microswitch 62 is normally open while microswitch 63 is normally closed. Control circuit 61 is energized from main leads 53, 54. It also has connected to it the potentiometer 39 previously discussed in relation to FIG. 2 and it has connected to it the photocells 35, 36. These photocells are connected to parallel as shown. Through a normally closed relay-operated switch 64 they are connected in parallel across a normally open microswitch 65 which, in turn, is connected to control circuit 61. Another control circuit 70 is also supplied with power from main leads 53, 54. This control circuit 70 has connected to it a potentiometer 71 and also the photocell 30 forming part of the candling arrangement of the machine of FIG. 1.

The light bulbs 32, 33, 34 are all connected in parallel across the secondary winding of a transformer 72 whose primary derives its power from main leads 53, 54.

Finally, there is a latching relay 73 connected in parallel with still another light bulb 74. There are two relay-operated, normally open switches 75 and 76 also connected in parallel with each other and in series with elements 73, 74 and there is s push-button switch 77 connected in series with all the foregoing. Together all of these elements 73 through 77 derive their power from main leads 53, 54.

Relay-operated switch 75 is under the control of control circuit 70 while relay-operated switch 76 is under the control of relay 73.

Timing for the operation of all three microswitches 63, 63 and 65 is provided by mechanical timing means. For switches 62 and 65, this is provided by the cams, driven by motor 57 in addition to driving the various cranks which actuate the suction cups. For switch 63 this is done by a small sensing finger which protrudes into the path of envelopes 12 as these are pulled out one at a time by suction cup 16. In contrast, relay switches 60, 64, 75 and 76 are operated by control circuits 61 and 70.

Consider first control circuit 70. As long as there is no envelope between light bulb 32 and photocell 30 (see FIG. 1) or, alternatively, as long as there is an envelope in that position from which the contents have been extracted previously at the extraction location, sufficient light will fall from light bulb 32 upon photocell 30 to maintain a low impedence condition within photocell 30. The control circuit 70 responds by causing switch 75 controlled by circuit 70 to remain open as shown in FIG. 3. As a result, latching relay 73 will remain unenergized. The indicator light 74 will remain unenergized and relay-controlled switch 76 which operates in response to latching relay 73 also remains open. On the other hand, relay-controlled switch 64 controlled by latching relay 73 will remain closed. This leaves other elements of the circuitry of FIG. 3 in control of whether or not the envelopes shall be moved by belts 20, 21 under the influence of motor 40 at this time. In other words the candling operation is then not the determining factor with respect to envelope movement.

Conversely, if there are contents left within an envelope when that envelope reaches the candling position in the machine of FIG. 1, sufficient light will be intercepted by those contents between light bulb 32 and photocell 30 that the impedance of the photocell 30 will rise to the point where control circuit 70 causes switch 75 to close. This energizes latching relay 73 which then in turn closes switch 76 and opens switch 64. The continuous path so provided between main leads 53, 54 through latching relay 73 now closed switch 76, and closed push-button 77 maintains this condition of switches 76 and 64. At this same time the mechanical control actions within the cycling mechanism will have opened microswitch 65. Therefore control circuit 61 will be facing a complete open circuit both through open microswitch 65 and through open relay control switch 64, regardless of the impedance condition of photocells 35, 36. Under those circumstances control circuit 61 opens control switch 60 and removes power from all the motors 57, 58 and 40, regardless of the condition of the respective individual control microswitches 62 and 63 of the latter.

The machine operation therefore comes to a complete halt except, of course, for the continued operation of blower motor 55 and vacuum pump motor 56. At the same time light 74 becomes illuminated, warning the operator of the machine of the situation. The operator then takes corrective action, inspecting the envelope at the candling station to determine whether there really are some contents still left or whether some other fortuitous circumstance has caused the manifestation. In either case, after being satisfied that all is in order or having removed the remaining contents from the envelope the operator pushes push-button 74. This interrupts the state of energization of latching relay 73 and turns off alarm light 74. Also, switch 76 controlled by latching relay 73 reopens and, conversely, switch 64 controlled by latching relay 73 recloses. Thereafter photocells 35, 36 again become effective, through variations in their impedance, to control the impedance which is "seen" by control circuit 61. If at that time there is no envelope at the extraction location, i.e., between light bulbs 33, 34 and photocells 35, 36, or if there is such an envelope and the contents have already been removed, the control circuit 61 will see a low impedance and this will cause it to control switch 60 so as to close. This re-energises the various motors and the cycling of the machine resumes.

Microswitch 65 is so actuated as to be closed during the period when each envelope is being transported along sloping shelf 18 toward the extraction location. During that time, control circuit 61 therefore sees a low impedance and control switch 60 remains closed leaving the motors 57, 58 and 40 in their energized condition depending, in the case of the latter two, only on the open or closed position of microswitches 62, 63. During this part of the cycle, photocells 35 and 36 have essentially no effect since they are bridged by the short circuit provided by closed microswitch 65. Microswitch 65 opens when the cycle reaches a stage at which an envelope 25 is at extraction location. At that point, photocells 35, 36 do become effective. Initially, assuming that the envelope and its contents are sufficient to intercept enough of the light from light bulbs 33, 34, these photocells will present a high impedance to control circuit 61. Since microswitch 65 is open at the same time, control circuit 61 will see a high impedance and, as previously explained, this will cause it to open control switch 60, thereby de-energizing all of the motors 57, 40 and 58. This condition will persist until the operator has extracted the contents from the envelope. At that time the intensity of illumination of photocells 35, 36 will rise and their impedance correspondingly decrease. Therefore, control circuit 61 will then see a comparatively low impedance (even though microswitch 65 remains open) and will cause control switch 60 to reclose, thereby resuming the cycling of the machine.

In this way it is seen how the various portions of the circuitry of FIG. 3 interact and cooperate to effect the desired timing of the operations within the machine of FIG. 1.

It will be noted that potentiometers 39 and 71 can be used to adjust the levels of illumination of the respective photocells at which the control action of control circuits 61 and 70 respectively takes place. This permits accommodating different types of envelopes and different types of contents.

It will be understood that the various elements of FIG. 3 may take any of a variety of conventional forms. For example, in particular, control circuits 61 and 70 may each be of the photo-relay circuitry type as sold by Automatic Timing and Controls Corporation under the Model No. 7209.

It will also be understood that various modifications of the apparatus embodying the present invention may be possible. For example, it is not essential that there be two sets of light bulbs and photocells at the extraction location. If desired, one set of such light bulb and photocell may be sufficient. However, it is believed that doubling up on these elements and positioning them as described above is advantageous in that it tends to compensate for variations in the positioning of the contents within the envelopes. Also, it may be desirable to position these sets of elements at different heights along the envelope, again for the same reason, namely, to compensate for uneven distribution of contents within any given envelope. In fact, it may even be desirable to provide more than two sets of these elements at the extraction location, operating upon different portions of the envelope, in situations in which there is possible an exceptionally wide variation in the contents distribution.

The embodiment of FIGS. 1 to 3 has been described in the context of complete stoppage of each envelope at the extraction location. However, it will be understood that such complete stoppage is not always essential. Rather, it is possible to merely slow down the envelopes as they reach the extraction location, sufficiently to give the operator adequate opportunity to remove the contents from the envelope. The apparatus embodying the present invention then serves to respond to content removal to re-accelerate the envelope movement, away from the extraction location. Conversely, if content removal is not sensed, then the machine can be brought to a complete stop and an appropriate alarm indication given.

Under these circumstances, suitable means would have to be used to spread each envelope open for extraction even while it continues to move.

Also, the use of suction through holes 55*a* (see FIG. 1) to keep the moving envelopes in contact with belts 20, 21 is not essential. Gravity can also be relied upon to maintain such contact, particularly if shelf 18 is positioned, more nearly, or even entirely horizontally, rather than being tilted upwardly at an angle, as in the preferred embodiment illustrated.

Another possible modification is this. The machine of FIG. 1 relies on light transmissivity through envelopes. However, it is possible to use other types of radiant energy. For example, accoustic transmitters may be utilized in lieu of the light bulbs 33, 34. In that case, accoustic receptors would be used in place of photocells 35, 36. This might be desirable in situations in which the envelopes themselves are so opaque that removal of contents from them would not produce a sufficient variation in the intensity of light transmitted through them from light bulbs 33, 34 to photocells 35, 36 to permit the system to react. In such situations the use of accoustic energy may enable the discrimination between envelopes with contents removed and unremoved whereas light would not be capable of doing so.

Other types of radiation, such as X-rays, are also potentially usable, particularly if the contents of the envelopes to be processed have characteristics which significantly impede the propagation of such radiation through the content-containing envelope. However, for safety reasons, it would normally not be desirable to use this type of atomic radiation.

On the other hand, radio frequency energy could be used in place of either light or sound waves. Moreover, a combination of different types of energy may be used for best results in order to afford latitude in the types of contents to be detected.

In any case, it is the very act of removing or extracting the contents which triggers the resumption of the movement of the envelope beyond the extraction location. In this way there are achieved the two otherwise inherently conflicting objectives, namely, to leave the envelope in position at the extraction station long enough for extraction to take place despite variations in the length of time that this might take under different circumstances, but without leaving it in that position any longer than is absolutely necessary.

We claim:

1. In a machine for facilitating the extraction by an operator's hand of contents from envelopes, said machine having means for transporting the envelopes substantially unspread in succession to a location at which each envelope is presented with one edge exposed to the operator's hand for content extraction, means at the extraction location for spreading each envelope open along the exposed edge and for discontinuing the spreading to permit the envelope to again become substantially unspread, and means for further transporting the envelopes substantially unspread away from the extraction location, the improvement comprising:

means for exposing the envelopes to radiant energy while spread open at the extraction location;

means for sensing the degree to which the radiant energy is transmitted through the spread open envelopes dependent on the presence or absence of contents in the envelopes; and means responsive to the sensing means to initiate the means for discontinuing of spreading and the means for transporting away of the envelopes in the absence of the contents.

2. The machine of claim 1 which includes means for stopping each envelope at the extraction location.

3. The machine of claim 1 wherein the exposing means includes a light source.

4. The machine of claim 3 wherein the sensing means includes light responsive means.

5. The machine of claim 3 wherein the light source includes a pair of spaced apart light emissive devices.

6. The machine of claim 5 wherein the sensing means includes a pair of photocells spaced apart in respective alignment with the light emissive devices.

7. The machine of claim 6 wherein the light source is positioned on the opposite side of the envelopes from the sensing means.

8. The machine of claim 6 wherein the light emissive devices and their respective aligned photocells are spaced apart in the direction of transporting of the envelopes.

9. The machine of claim 8 which further comprises suction cup means for spreading the envelopes open at the extraction location, and wherein the pairs of light emissive devices and photocells are each spaced generally symmetrically from the suction cup means.

10. The machine of claim 1 which further includes means for controlling the means for transporting the envelopes away from the extraction station, the controlling means being responsive to a plurality of means each capable of assuming at least two different conditions to initiate or not the transporting away, the condition of at least one condition assuming means being determined by the sensing means.

11. The machine of claim 10 wherein the controlling means includes electronic circuit means responsive to different impedance values across its terminals to cause a switch means to assume one or the other of its two switching states, the sensing means being connected to the terminals and being responsive to different degrees of radiant energy transmission through the envelopes to assume the said different impedance values.

12. The machine of claim 11 wherein the impedance value is high before the contents have been extracted and becomes low after the contents have been extracted from any given envelope.

13. The machine of claim 10 further including means for detecting the presence of unextracted contents in the envelopes after they have been transported away substantially unspread from the extraction location, the detecting means determining the condition of another of the condition assuming means.

14. The machine of claim 13 wherein the other condition assuming means is operative to render the electronic circuit means non-responsive to the impedance value of the sensing means when the detecting means senses the presence of unextracted contents.

* * * * *